US011412829B2

(12) United States Patent
Seminara

(10) Patent No.: US 11,412,829 B2
(45) Date of Patent: Aug. 16, 2022

(54) HAIR COLOURING TOOL

(71) Applicant: Angelo Seminara, London (GB)

(72) Inventor: Angelo Seminara, London (GB)

(73) Assignee: Angelo Seminara, London (GB)

( * ) Notice: Subject to any disclaimer, the term of this patent is extended or adjusted under 35 U.S.C. 154(b) by 166 days.

(21) Appl. No.: 16/308,288

(22) PCT Filed: Jun. 8, 2017

(86) PCT No.: PCT/EP2017/063945
§ 371 (c)(1),
(2) Date: Dec. 7, 2018

(87) PCT Pub. No.: WO2017/211942
PCT Pub. Date: Dec. 14, 2017

(65) Prior Publication Data

US 2019/0261758 A1 Aug. 29, 2019

(30) Foreign Application Priority Data

Jun. 10, 2016 (GB) ..... 1610154

(51) Int. Cl.
*A45D 19/00* (2006.01)

(52) U.S. Cl.
CPC ..... *A45D 19/00* (2013.01); *A45D 19/0075* (2021.01)

(58) Field of Classification Search
CPC ..... A45D 19/00; A45D 2019/0075; A45D 19/0008; A45D 20/02; A45D 19/0016; A45D 19/0025
See application file for complete search history.

(56) References Cited

U.S. PATENT DOCUMENTS 3,599,647 A 8/1971 Fabbri
4,224,954 A * 9/1980 Stahl ..... A45D 7/04 132/208
4,398,549 A 8/1983 Thomas
4,552,159 A * 11/1985 Fabbri ..... A45D 19/0025 132/207
4,776,822 A * 10/1988 Dougherty ..... H01J 9/2272 445/45
4,790,786 A * 12/1988 Stauss ..... H01J 9/00 160/371
D316,762 S * 5/1991 Rizzuto ..... D28/35
5,156,172 A * 10/1992 Tancredi ..... A45D 19/0025 132/207

(Continued)

FOREIGN PATENT DOCUMENTS

DE 20104669 6/2002
EP 0615709 9/1994

(Continued)

OTHER PUBLICATIONS

International Search Report and Written Opinion dated Aug. 4, 2017 corresponding to International Patent Application No. PCT/EP2017/063945, 11 pages.

*Primary Examiner* — Nicholas D Lucchesi
(74) *Attorney, Agent, or Firm* — Leason Ellis LLP

(57) ABSTRACT

The present invention relates to a hair colouring tool which can be used for creating coloured patterns or designs in the hair in an extremely accurate and efficient way. The pattern or design is achieved by dying and bleaching so that the patterned areas are either darker or lighter than the natural hair colour.

18 Claims, 9 Drawing Sheets

(56) References Cited

U.S. PATENT DOCUMENTS

| | | | | | |
|---|---|---|---|---|---|
| 5,469,873 | A * | 11/1995 | Guth | A45D 19/0016 | 132/270 |
| 5,664,590 | A * | 9/1997 | Plateroti | A45D 19/0025 | 132/270 |
| 5,913,315 | A * | 6/1999 | Todd | A45D 2/40 | 132/206 |
| 8,033,286 | B2 * | 10/2011 | Perry | A45D 19/0025 | 132/270 |
| 8,132,576 | B1 * | 3/2012 | Trottier | A45D 19/0008 | 132/270 |
| 8,671,954 | B2 | 3/2014 | Conn | | |
| 8,939,160 | B2 * | 1/2015 | Falcucci | A45D 19/0008 | 132/270 |
| 2002/0148370 | A1 | 10/2002 | Erdmann | | |
| 2014/0109927 | A1 * | 4/2014 | Simard | A45D 34/046 | 132/200 |

FOREIGN PATENT DOCUMENTS

| | | |
|---|---|---|
| EP | 1915920 | 4/2008 |
| GB | 2073672 | 10/1981 |
| KR | 20020007797 | 1/2002 |
| WO | 2013098136 | 7/2013 |

* cited by examiner

HAIR COLOURING TOOL

FIELD OF THE INVENTION

The present invention relates to a hair colouring tool which can be used for creating coloured patterns or designs in the hair in an extremely accurate and efficient way. The pattern or design is achieved by dying and bleaching so that the patterned areas are either darker or lighter than the natural hair colour.

BACKGROUND TO THE INVENTION

Numerous techniques are available for the colouring of hair. In order to achieve control of the colouring and bleaching process, techniques have been developed for isolating the hair to be treated from the rest of the head of hair. One of these is the use of a cap, similar to a bathing cap which fits closely over the head. The cap has a plurality of tiny holes through which a hairdresser can pull small strands of hair using a crochet hook or the like. The strands of hair which have been separated from the remainder of the head of hair can then be bleached or dyed.

Foiling is a high maintenance and the most traditional way of colouring the hair where selected strands of hair are placed on sheets of foil or plastics and the colour is painted on. The free end of the sheet is then folded or rolled towards the head to trap the isolated strand of hair within the foil. Since typically it is desired to treat a number of strands of hair in this way, it becomes difficult to hold the foil in place as the dye or bleach is being applied to other strands of hair and indeed during the waiting time while the bleach or dye is left on the hair to bring about the dying effect. It is an ideal technique for clients that want their hair highlighted or coloured from root to ends.

Other techniques are available which give a more natural, sun kissed look to the hair. Ombré is a technique which involves going darker at the root and gradually getting lighter at the ends of the hair. The advantage of ombré is that it can work for any hair type or colour. If the hair is highlighted already, it is possible to just paint on a 'fake' root and make it look like the colour has grown out for a few months. Sombré is a more subtle version of ombré. The colour transition is also much more gradual so there are no lines of demarcation, which means less touch-ups, making it a lower maintenance, less expensive alternative to ombre.

Another method involves the use of liquid-impermeable or liquid-resistant sheets which incorporate a layer of adhesive. Typically the process of highlighting, lowlighting or streaking hair involves separating a portion of the hair which is to be treated, from the remaining hair on the head, sticking one side of a liquid-impermeable sheet or strip to the portion of hair separated at the roots of the hair, spreading a bleach, tint or a dye over the separated strand of hair and then folding the other end of the sheet over the treated hair to form an envelope, which separates the treated hair from the remainder of the hair on the head. The sheets are typically impermeable to liquid and may be made of aluminium foil, or a plastics material. They can be formed with a fold approximately along the length of the strip so that the two ends of the sheet can be folded together to trap a strand of hair between them. Often there is a strip of adhesive at one edge of the sheet which sticks to the hair to hold the strip on the hair, and which also sticks to the other half of the sheet when it is folded over. There is often a removable cover to protect the adhesive strip prior to use. By separating a strand of hair, placing it on the sheet, applying the bleach, tint or dye and then folding over the cover, the strand of hair which is treated is separated from the hair so that when the bleach, tint or dye is ultimately removed only a portion of the hair has a colour change, thus creating a highlighted, lowlighted or streaked effect in the hair. One of the most basic methods of bleaching or colouring hair to achieve a highlighted, lowlighted or streaked effect or to achieve any type of hair colouring, is for the bleach, tint or dye to simply be painted directly onto sections of the head of hair, this method is sometimes known as balayage. Balayage is a French word for sweep, so essentially Balayage is a freehand painting in which highlights are painted on areas of the hair in a sweeping motion, which creates a graduated natural-looking effect. This means that highlights will be in chunkier sections, making it seem like the sun naturally lightened the hair. Because no foils or meche are used to apply product, sections are less saturated than typical highlights and regrowth lines are less noticeable. It is great for clients who want a natural look with some contrast in the hair. However this method typically only allows the upper most strands of hair to be coloured. Also typically the liquid dye or bleach can penetrate the entire head of hair reaching the underlying strands resulting in much larger blocks of colour, which is undesirable.

Flamboyage is another hair colouring technique in which the meche is applied to the hair and whereby the hair sticks to the adhesive part of the meche. With a lifting action a random part of the section of hair sticks to the meche, or the meche is used like a normal foil but hair is fixed by adhesive to the meche, so a much more accurate colouring effect is achieved which results in the hair ends being lightened a little more. This process incorporates elements of both balayage and ombré techniques to give the hair more depth and a natural-yet-polished result. It utilises clear meche strips instead of foils. A colourist sticks the adhesive side of each strip to a layer of hair and then lifts it up. A random selection of hair stays in place on the meche that is then painted balayage-style. It creates a natural, mixed-in look.

A still further colouring effect for the hair is the use of stencils to create a pattern or design on the hair. A variety of stencils are available in which holes or slits are cut in a layer of plastics material or metal to create a particular design. The hairdresser then selects a layer of hair and isolates it from the rest of the hair on the head. The stencil is placed over this layer of hair and a colouring dye or bleach is painted on top of the stencil. The colour penetrates to the layer of hair in the region of the holes or slits to create a pattern of colour on the hair. The technique is the advantage of producing very unique and specialised patterns in the hair which are very dramatic. However the technique is difficult to execute since it is necessary to hold the stencil firmly against the layer of hair as the colour or bleach is being applied or otherwise there is a smudging effect which results in a bleeding of colour around the edges of the pattern given a blurred look to the design. It may be necessary for two people to apply the technique, one holding the stencil firmly in place and the other applying the colouring agents but this itself has drawbacks since one person will inevitably get in the way of the other.

OBJECT OF THE INVENTION

It is an object of the invention to provide an improved device for applying patterns or designs to the hair which avoids smudging or blurring the outline of the design or pattern. A further object is to provide a tool or device which allows crisp, sharp outlines to the patterns applied to the hair.

A still further object is to remove the necessity for two people to be involved in applying the pattern to the hair and to enable one person to achieve a good result. A still further object is to reduce the time and effort involved in creating the patterns and designs on the hair. It is also an object of the invention to provide a simple, economical and effective tool and method for achieving patterns or designs in the hair.

SUMMARY OF THE INVENTION

According to the present invention there is provided a device for producing patterned effects in the hair comprising a substantially planar element having means to engage a stencil which is attractable to a magnet, the planar element also comprising a magnetic means which is adapted to attract the stencil and hold it firmly in contact with the planar element.

The planar element may be made of a magnetised material such that the planar element is the magnetic means. Alternatively the magnetic means is a magnet which is located inside the planar element. In a still further embodiment of the magnetic means may be a magnet which is located on the underside of the planar element.

Suitably the means to engage the stencil is a rim formed on the planar element along at least two of its sides, the rim defining a channel into which a stencil can be placed.

Preferably the device is provided with an indentation into which a protrusion provided on the edge of a stencil can fit. The engagement of the protrusion into the indentation serves to hold the stencil in place. The protrusions and indentations allow the hairdresser to line up the stencil accurately so the colour pattern is not distorted along the hair. Suitably at least two indentations are provided on the device which are engageable with at least two protrusions on the stencil. Preferably the indentations are provided in pairs along the length of the device, each of the pair of indentations being provided equidistantly along the length of the device so that they oppose each other. Similarly the protrusions are provided equidistantly along the edge of the stencil so that they also oppose each other in pairs.

In certain embodiments the protrusions or indentations are provided on the rim of the device.

In an alternative embodiment the rim may be provided with the protrusions and the stencil may be provided with the indentations. These may also be arranged in opposed pairs and one pair of protrusions and indentations may be bigger than the rest.

Preferably the planar element is oblong in shape, having two long sides and two short sides, and one of the short sides of the oblong is curved along its edge. In use this curved edge will sit comfortably against the head of the person whose hair is being coloured.

Preferably the short side of the device which is not curved is provided with an indentation which is roughly in the shape of a finger or thumb. This indentation allows the hair colourist to remove the stencil from the device.

Preferably the underside of the device i.e. the side of the device which does not abut the stencil is provided with a handle which projects out of the plane of the device and which can be used by the hair colourist to firmly grip the device. Suitably the handle is formed in an hour-glass shape to accommodate both left handed and right handed people. In an hour-glass shaped handle the thicker part of the handle is in the middle and this tapers at either end. The handle may be shaped to fit large and small hands. As will be appreciated by the skilled person, other shapes of handle would also be suitable. Alternatively, the handle may be hinged so that it closes against the planar element when the device is not in use. Preferably the handle is provided with a means to improve grip. A plurality of textured dots may be provided on the handle to improve grip.

Alternatively the handle may be provided with ridges or grooves which make the handle easier to grip.

Preferably the planar element and/or the handle are provided with thickened areas to provide rigidity of the tool and at the same time ensure that the device was as light as possible.

The invention also provides a kit of parts comprising a device as defined above, together with at least one stencil which is engageable with the planar element of the device and the stencil being made of a material which is attracted by the magnetic means. Preferably the kit comprises two or more, three or more, four more or five or more stencils.

In a further aspect the invention provides a stencil being attractable by a magnet, the stencil having at least one protrusion provided along the length of the stencil, the protrusion being engageable with an indentation on the device of the invention. Preferably the protrusions are provided in pairs, each of the pair being provided equidistantly along the length of the stencil so that they oppose each other.

Preferably the end of the stencil which would abut the head in use, is provided with a pair of projections which oppose each other across the width of the stencil, the projections being larger than the protrusions on the stencil. When a stencil is placed in the device these projections are seated outside the means to engage the stencil. In other words these projections are located outside the device in use. This feature aids location of the stencil in the device and also removal of the stencil from the device.

The stencil may be made of a material which is attracted by a magnet and it may further be coated with a material which is impermeable to hair dye or bleach in order to avoid staining the stencil. Suitable materials would be dye or bleach impermeable plastics. The stencils may be formed with any of a variety patterns, so for example the stencil could be for a series of hearts, diamonds, stars or the like, or it could be formed with a series of slits or slots in wave patterns or to give a leopard skin effect. The possibilities are endless.

DETAILED DESCRIPTION OF THE DRAWINGS

Figure 1:
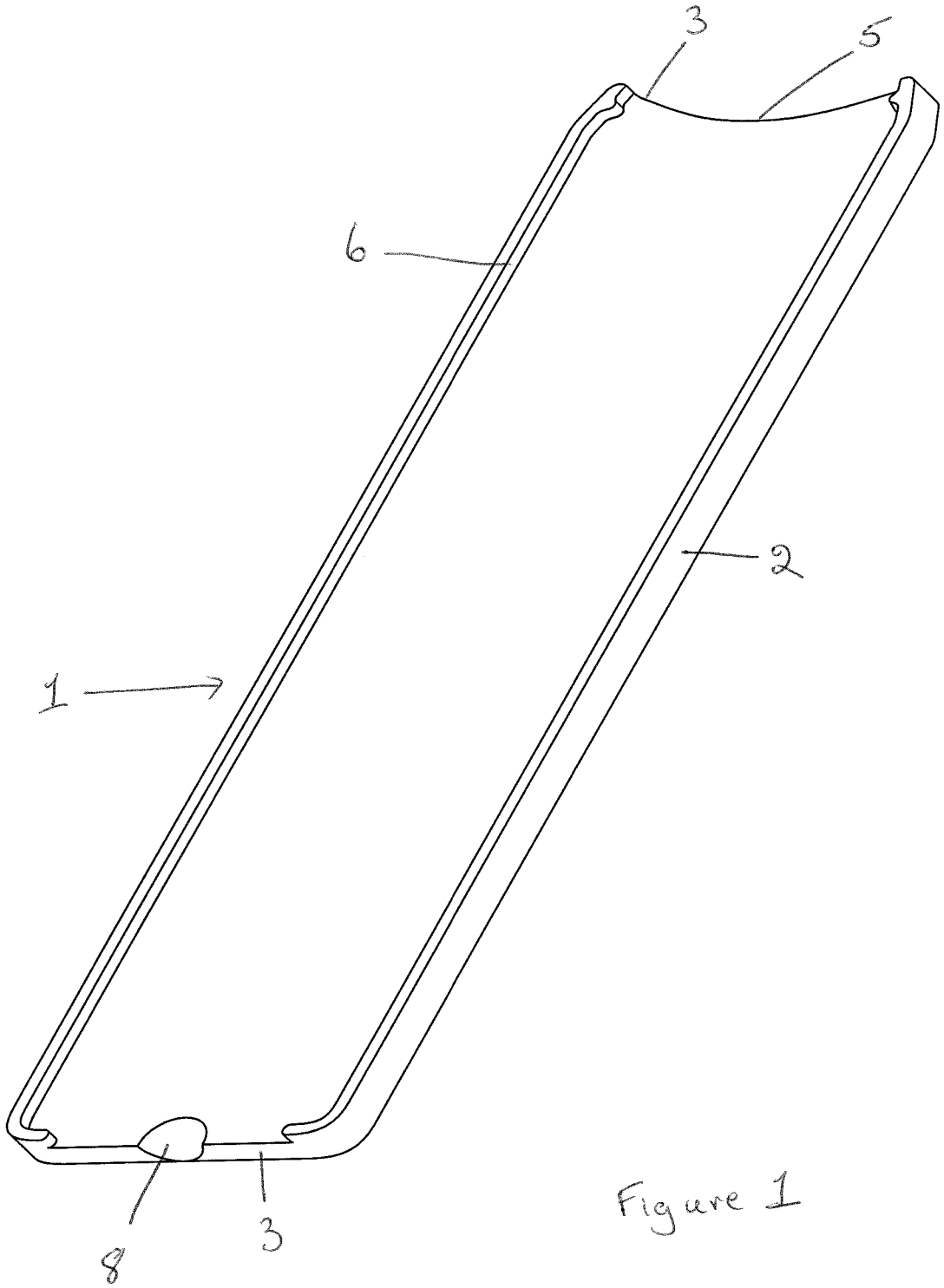
FIG. 1 shows a first embodiment of a device for creating coloured patterns or designs in the hair in accordance with the present invention.

One embodiment of the present invention is shown in FIG. 1. The device comprises a planar element 1 which is oblong in shape, they oblong having two long sides 2 and two short sides 3. One of the short sides 3 is formed with a curved edge 5 which generally conforms to the curvature of the human head. This means that in use this edge of the device can be placed comfortably against the head of the person whose hair is to be coloured.

The planar element 1 is formed with a rim 6 which projects above the plane of the planar element 1 on each of the long sides 2. The rim 6 is adapted to retain a stencil which may be placed on the planar element 1.

Figure 4:
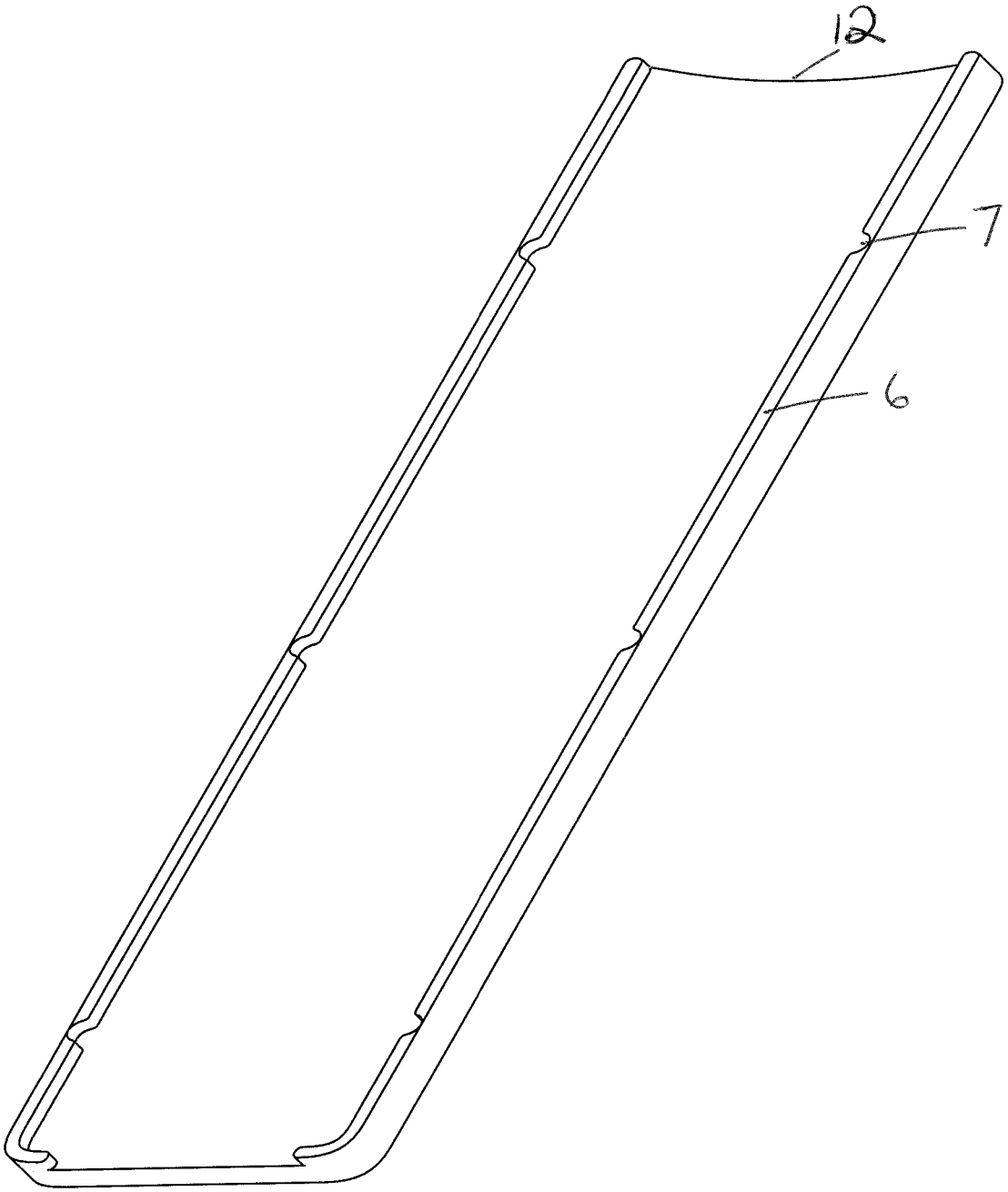
FIG. 4 shows an alternative embodiment of a device in accordance with the present invention with a means for accurately locating the stencil within the device.

FIG. 4 shows an alternative embodiment of the device in which rim 6 is also provided with pairs of indentations 7 which are parallel to each other so that they oppose each other. It would however be possible to provide alternative embodiments of the device in which these indentations 7 are positioned in different numbers and at different locations along the rim 6.

The short side 3 of the device which is not curved is provided with an indentation 8 which is roughly or generally in the shape of a finger or thumb, as shown in FIG. 1. This indentation 8 allows the hair colourist to easily remove the stencil from the device. This can be achieved by sliding a finger or thumb into the indentation which is then between the stencil and the device so that the hair colourist can then flick the stencil out with a finger or thumb.

Figure 2:
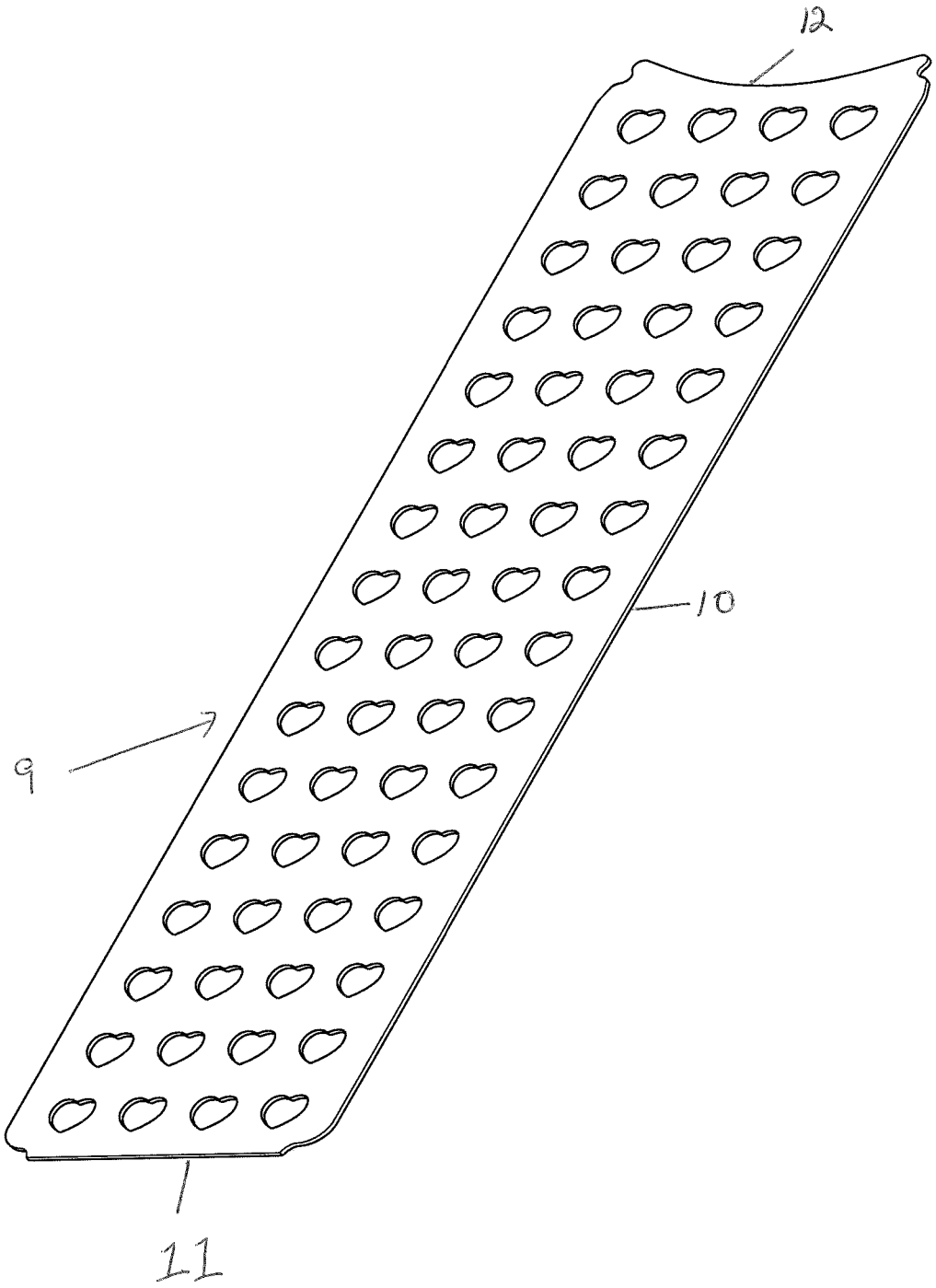
FIG. 2 shows an embodiment of a stencil for use with the device of FIG. 1.
Figure 3:
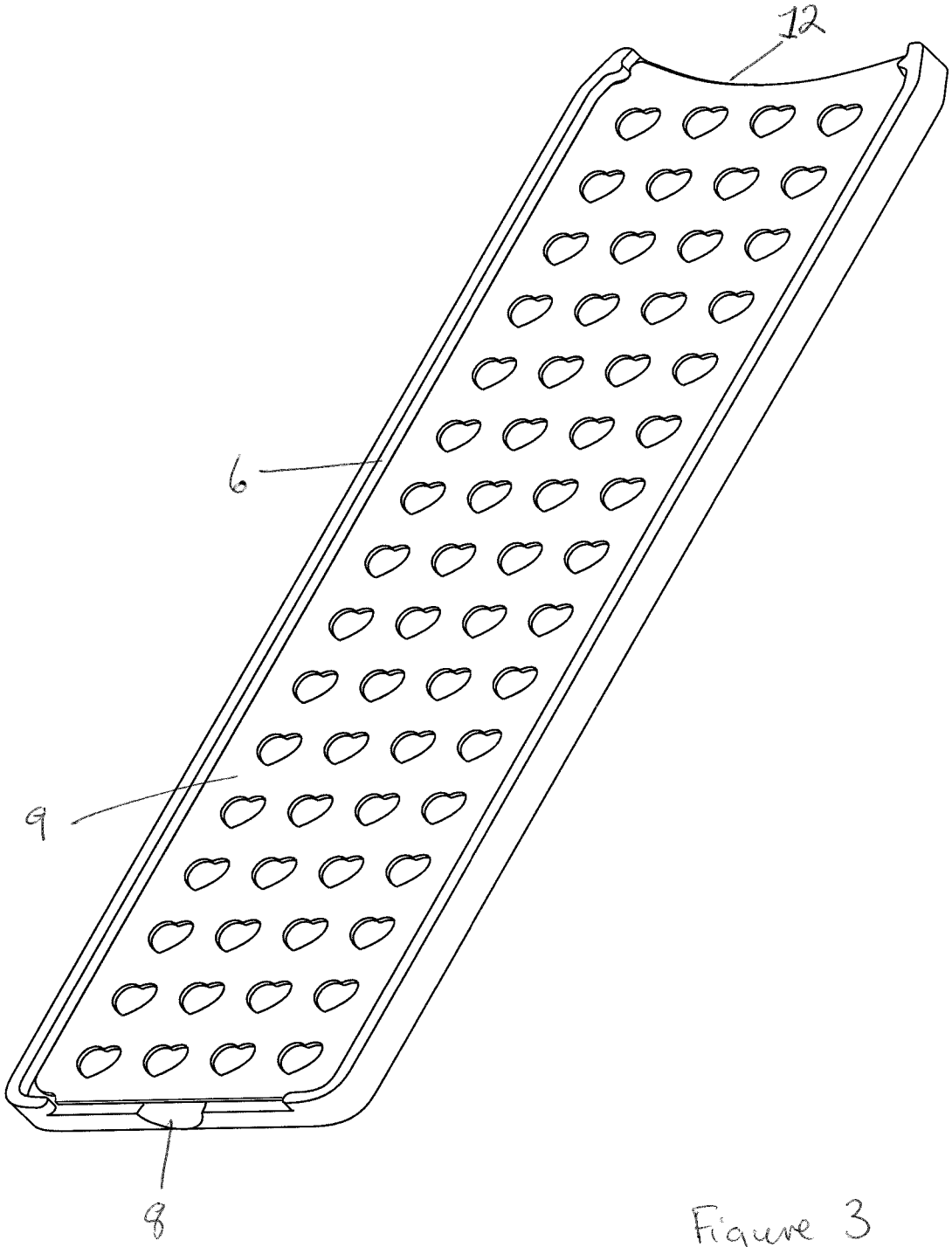
FIG. 3 shows an embodiment of the device with the stencil in place.

FIG. 2 shows a stencil 9 for use with the device of FIG. 1. The stencil 9 is oblong with two long and two short sides 10 and 11 respectively. The stencil 9 is adapted to fit within the rim 6 on top of the planar element 1. The stencil is provided with a curved short edge 12, the curvature being approximately the same as the curvature provided on the short edge 5 of the device.

Figure 5:
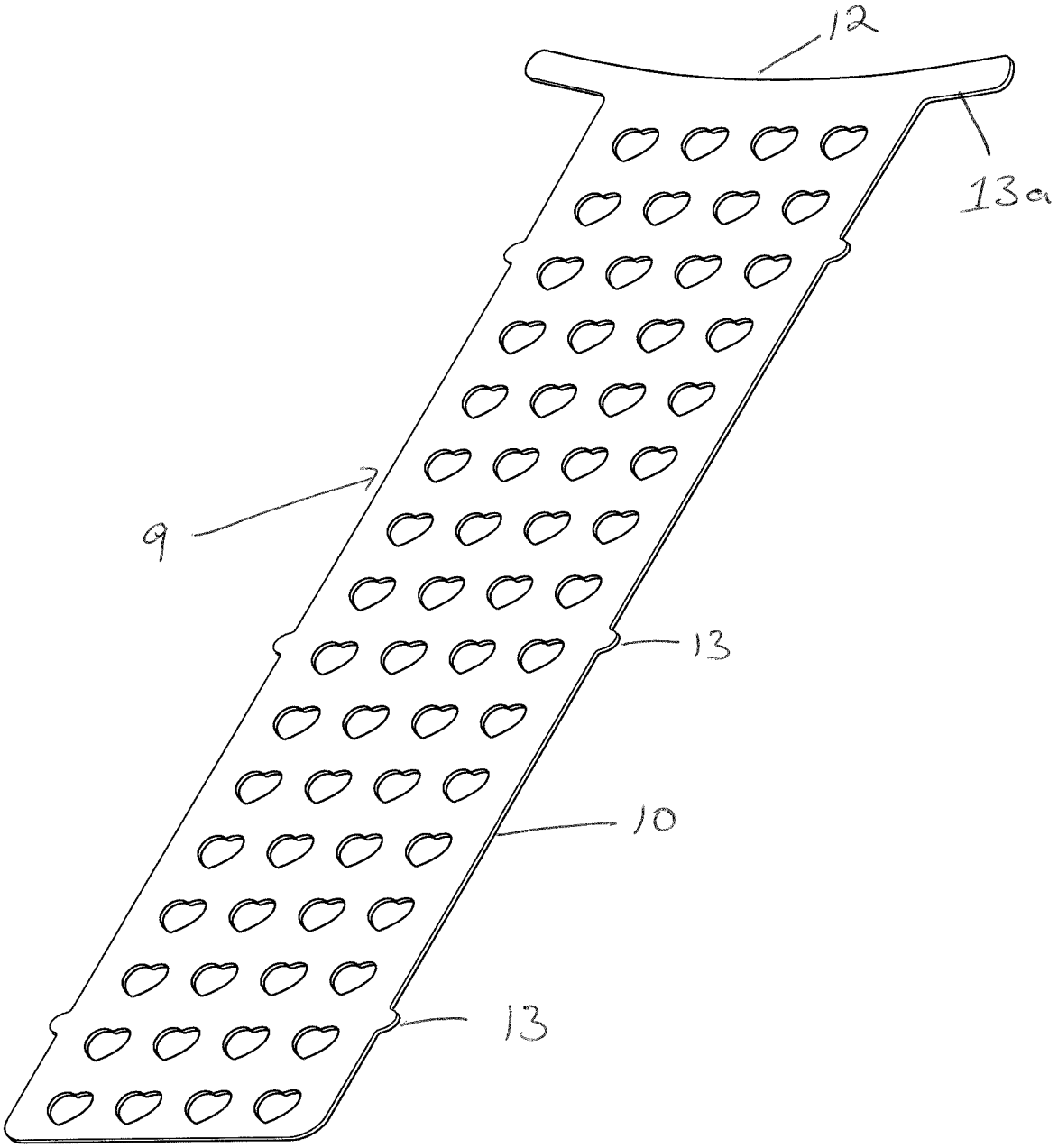
FIG. 5 shows an embodiment of a stencil for use with the device of FIG. 4.
Figure 6:
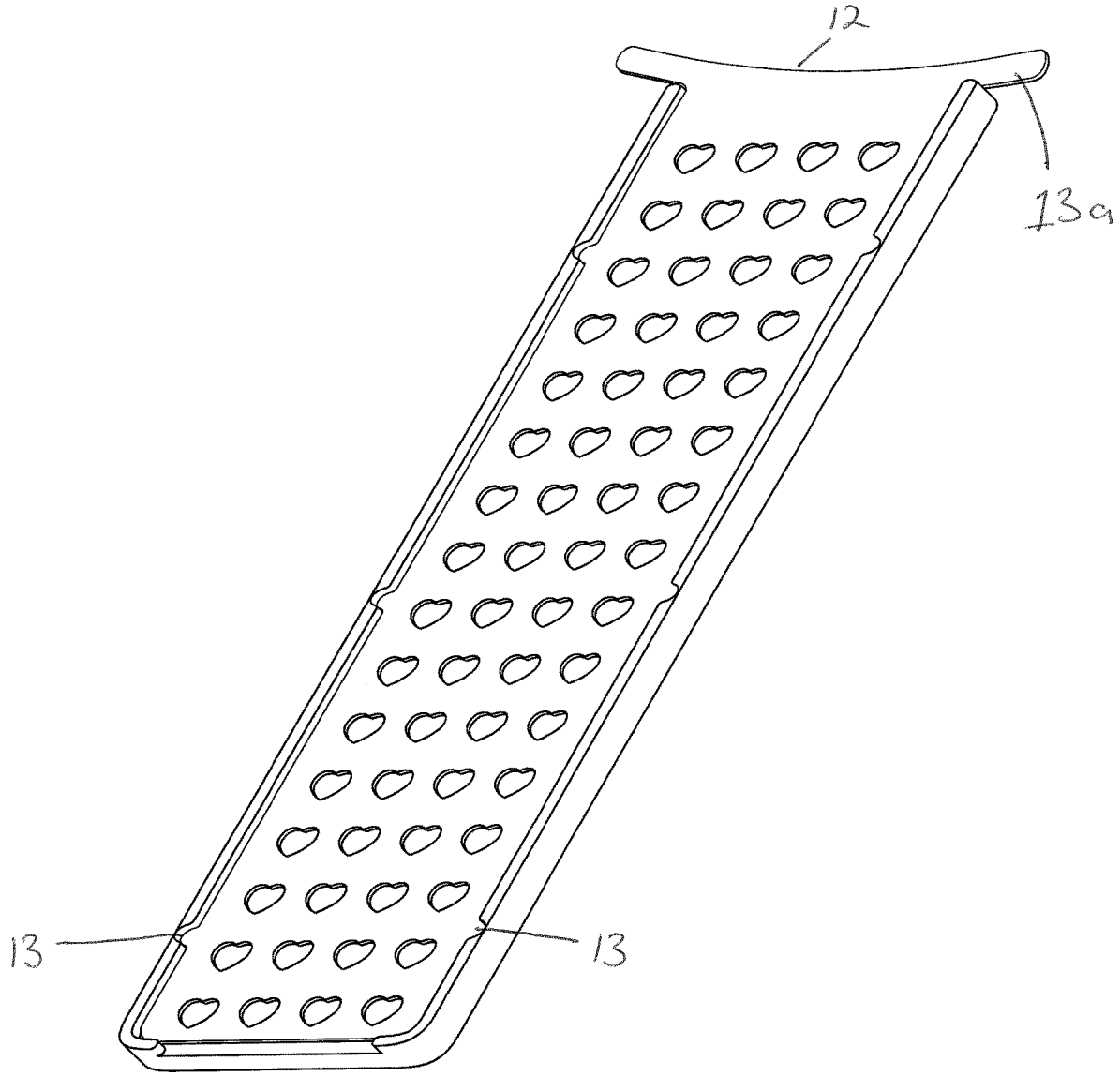
FIG. 6 shows an embodiment of the device of FIG. 4 with the stencil in place.

In the embodiment of the stencil shown in FIG. 5 the stencil 9 is also provided with pairs of protrusions 13 on the long sides 10, which oppose each other. In the embodiment shown the stencil is also provided with a pair of projections 13*a* located close to the curved edge 12 of the stencil, and which are parallel to each other across the width of the stencil, these projections being larger than the protrusions 13. The protrusions 13 are adapted to be engageable with the indentations 7 which are provided on the device. When a stencil is placed in the device these projections 13*a* are seated outside the device in use. This feature aids location of the stencil in the device and also removal of the stencil from the device.

The stencil 9 is thus adapted to seat with in the device on top of the planar element 1, and between the longitudinal rims 6. The indentations 7 and the protrusions 13 co-operate to hold the stencil 9 in place on the device without it slipping. The planar element 1 is provided internally with a magnet (not shown). The stencil 9 is made of a material which is attracted to the magnet so that the magnet holds the stencil firmly in place in the device.

Figure 7:
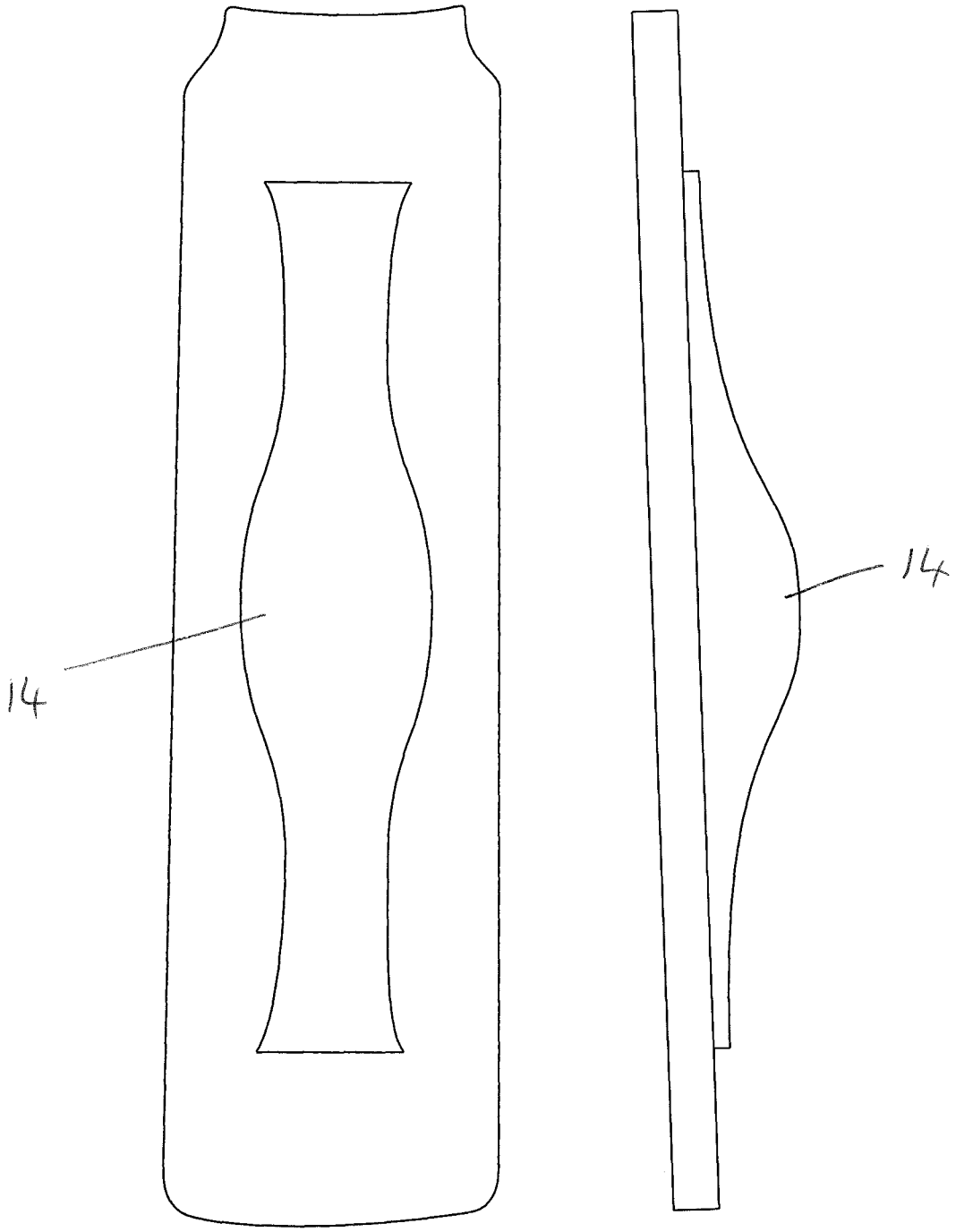
FIG. 7 shows the underside of the device with a first embodiment of a handle.
Figure 8:
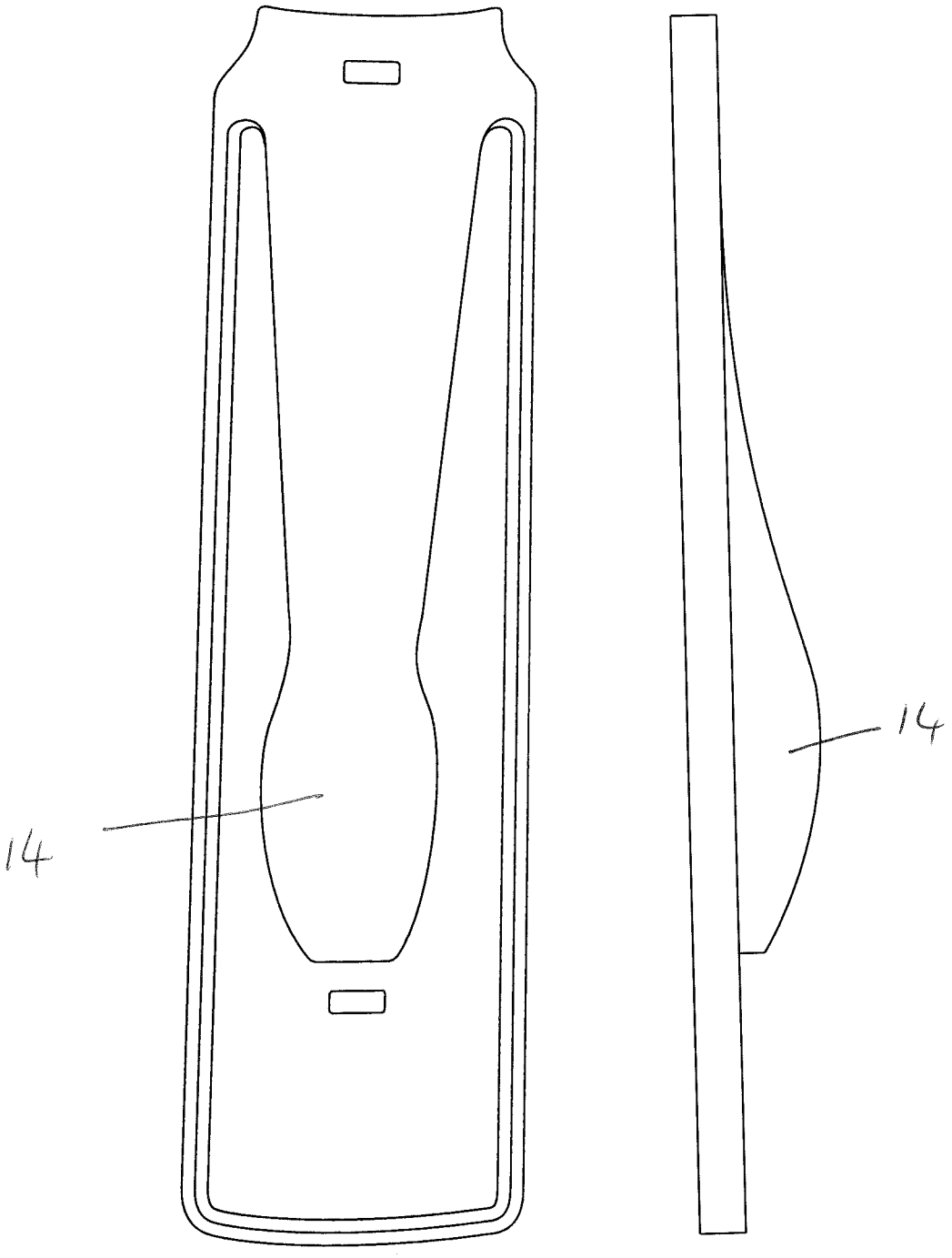
FIG. 8 shows the underside of the device with a second embodiment of a handle.

As shown in FIG. 7 the device 1 is provided with an integral handle 14 which protrudes from the underside of the device and which projects out of the plane of the device and which can be used by the hair colourist to firmly grip the device. In this embodiment the handle 14 is of an hour-glass shape. Alternative shapes are possible, such as that shown in FIG. 8.

Figure 9:
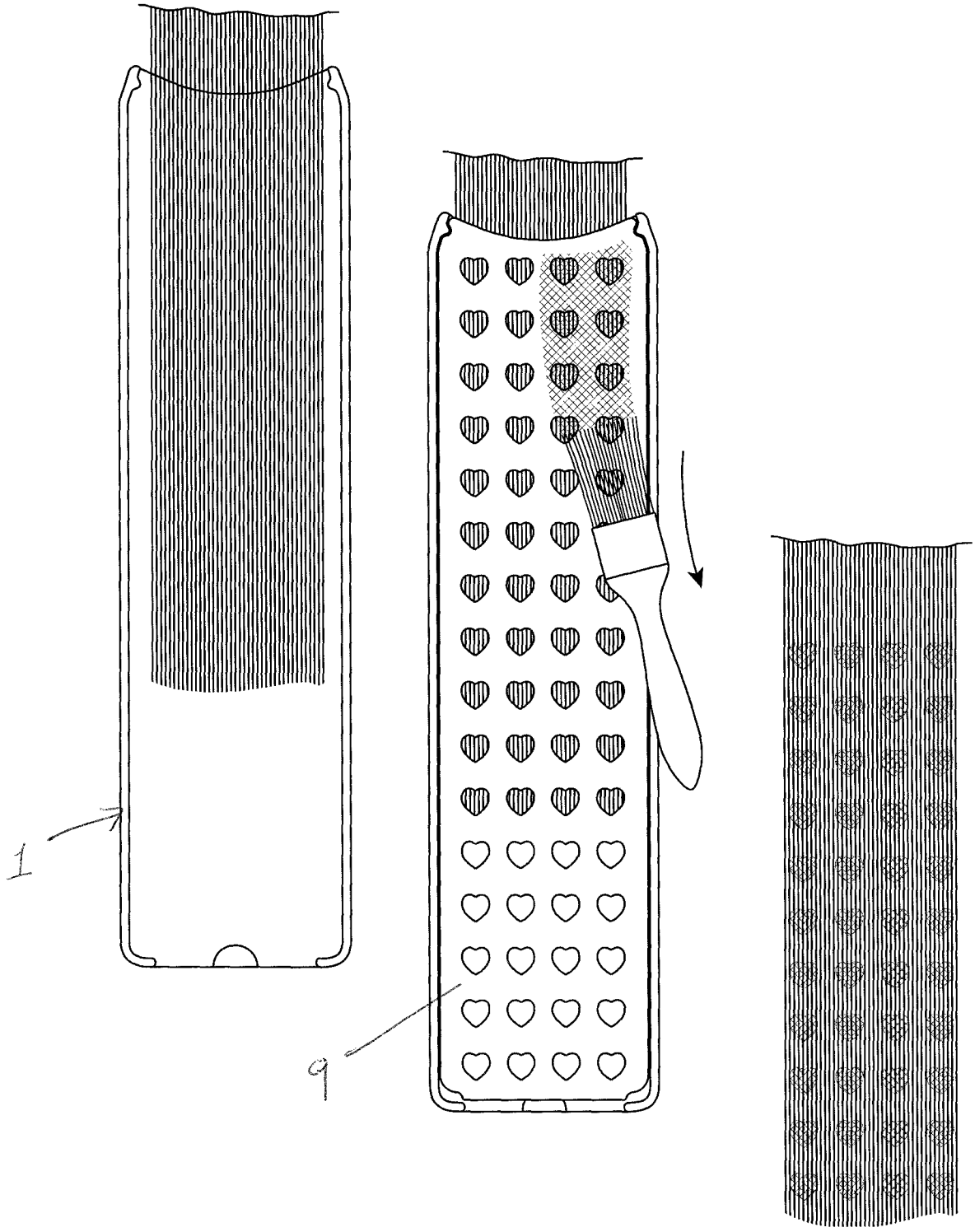
FIG. 9 depicts the process of using the device of the invention to produce a coloured pattern on the hair.

Use of the device is depicted in FIG. 9. To use the device of the invention, the hair colourist separates a swatch of hair from the remainder of the hair on the head and combs it through. The device of the invention is then placed beneath the swatch of hair with the curved edge abutting the head of the person having the hair patterned as shown in FIG. 9. The swatch of hair is adjusted to lie flat on the planar element of the device and the stencil is then placed on top of the hair as shown in FIG. 9. The stencil is accurately located on the hair by virtue of the rim and protrusions and is held firmly in place by the magnet. The hair colourist then paints hair dye or bleach over the stencil and where there is a cutaway portion of the stencil, the hair dye or bleach is applied directly to the hair. The stencil is then removed from the hair and the device is also removed. The hair dye or bleach is then left to develop in the usual manner and washed away to leave a coloured pattern on the hair as shown in FIG. 9.

The tool is economic to use because it is durable and may be made from plastics such as Polyethylene terephthalate or similar materials. This is unlike foils and meches which can only be used once and which must then be thrown away. In addition the device and the stencil may be made from recyclable materials.

It is extremely fast to colour a whole head of hair using this tool, as the stencil need only be placed on the hair for about 20 to 30 seconds while the dye is being applied. It can then be removed and the hair colourist moves on to the next sections of hair. This means that even a junior hairdresser can achieve complex colours quickly and accurately, which would be impossible to do using the colouring methods currently on the market. In addition multiple colours can easily be applied to the same section of hair at one time. It would thus be possible to have faded colours or layers of block colour all applied and developed at the same time. This again would be very difficult to achieve with currently commercially available colouring methods.

Using this tool the hairdresser can apply colour to any part of the hair easily and accurately i.e. roots, mid lengths or ends, which is difficult to do with existing colouring methods. In addition the planar element can also be used with a spatula and without the stencil for applying ballyage colour.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A device for producing patterned effects in the hair, consisting of a single substantially planar element having means to engage a stencil, the stencil being attractable to a magnet, the planar element also comprising a magnetic means which is adapted to attract the stencil and hold it firmly in contact with the planar element, an underside of the device being provided with a handle which projects out of the plane of the device, wherein the handle is configured to be used by a user to hold the device.

2. The device as claimed in claim 1, wherein the magnetic means is a magnet which is located on the underside of the planar element.

3. The device as claimed in claim 1, wherein the planar element is made of a magnetised material such that the planar element is the magnetic means.

4. The device as claimed in claim 1, wherein the planar element is formed with a rim along at least two of its sides, and wherein the rim is provided along its length with a groove into which a stencil is to be placed.

5. The device as claimed in claim 1, wherein the planar element is provided with at least one protrusion which is engageable with at least one indentation provided on an edge of a stencil.

6. The device as claimed in claim 5, wherein the at least one indentation is provided in opposed pairs along the sides of the stencil.

7. The device as claimed in claim 1, wherein the planar element is provided with at least one indentation which is engageable with at least one protrusion provided on an edge of a stencil.

8. The device as claimed in claim 7, wherein the at least one indentation is provided in opposed pairs along the sides of the planar element.

9. The device as claimed in claim 1, wherein the planar element is oblong planar element in shape, the oblong having two long sides and two short sides, wherein one of the two short sides of the oblong planar element is curved.

10. The device as claimed in claim 9, wherein a short side of the planar element which is not curved is provided with an indentation which is roughly in the shape of a finger or thumb.

11. The device as claimed in claim 1, wherein the handle is of an hour-glass shape.

12. The device as claimed in claim 1, wherein the handle is hinged so that it closes against the planar element when the device is not in use.

13. The device as claimed in claim 1, wherein a plurality of textured dots are provided on the handle to improve grip.

14. The device as claimed in claim 1, wherein the planar element and/or the handle are provided with thickened areas to provide rigidity of the device.

15. A kit comprising (i) the device as claimed in claim 1, and (ii) a stencil being attractable to a magnet and having at least one protrusion provided along the length of the stencil, the at least one protrusion being engageable with an indentation on the device of claim 1.

16. The kit as claimed in claim 15, wherein the stencil comprises a plurality of protrusions which are provided in pairs, each pair of protrusions being provided equidistantly along the length of the stencil so that they oppose each other.

17. The kit as claimed in claim 16, wherein the protrusions are provided in opposed pairs along the sides of the stencil.

18. The kit as claimed in claim 15, wherein an end of the stencil which abuts the head in use, is provided with a pair of projections which oppose each other across the width of the stencil, the projections being larger than the at least one protrusion on the stencil.

* * * * *